United States Patent [19]

Archenholtz

[11] 4,278,240

[45] Jul. 14, 1981

[54] POWDER INJECTION APPARATUS WITH SIEVING APPARATUS

[75] Inventor: Åke Archenholtz, Vesteras, Sweden

[73] Assignee: Asea Aktiebolag, Vesteras, Sweden

[21] Appl. No.: 67,020

[22] Filed: Aug. 16, 1979

[30] Foreign Application Priority Data

Aug. 22, 1978 [SE] Sweden ..... 7808832

[51] Int. Cl.[3] ..... C21C 7/00

[52] U.S. Cl. ..... 266/216; 406/75; 406/151

[58] Field of Search ..... 266/216, 225, 226, 265; 406/75, 151; 209/250, 321, 312, 325, 329, 240

[56] References Cited

U.S. PATENT DOCUMENTS

| | | | |
|---|---|---|---|
| 3,001,864 | 9/1961 | Muller et al. | 266/226 |
| 3,662,886 | 5/1972 | Kennedy, Jr. | 209/250 |
| 3,948,764 | 4/1976 | Edwards | 209/250 |
| 4,139,185 | 2/1979 | Henryson | 266/226 |

FOREIGN PATENT DOCUMENTS

| | | | |
|---|---|---|---|
| 449501 | 6/1948 | Canada | 406/151 |

OTHER PUBLICATIONS

Perry, R. H.; *Chemical Engineers' Handbook,* 4th Edition, McGraw-Hill, New York, N.Y., pp. 6-13 to 6-15, (1963).

*Primary Examiner*—Michael L. Lewis

*Attorney, Agent, or Firm*—Watson, Cole, Grindle & Watson

[57] ABSTRACT

The invention relates to an apparatus for injection of powder in a metal melt, a charging container being filled by means of an ejector via a sieve for separation of coarser grains. The charging container is combined with a lance for immersion into the melt.

7 Claims, 2 Drawing Figures

POWDER INJECTION APPARATUS WITH SIEVING APPARATUS

BACKGROUND

1. Field of the Invention

The present invention relates to an apparatus for injection of powder into a metal melt, comprising a charging container for powder (powder sender) and an injection apparatus, such as a lance, and more particularly to such apparatus in which the powder is sieved prior to injection in the melt.

2. Prior Art

U.S. patent application Ser. No. 970,803, filed Dec. 18, 1978, now U.S. Pat. No. 4,244,562 discloses an injection apparatus of the type specified herein, and the present application is an improvement of the apparatus according to the older application.

In the apparatus according to the older application there is obtained a solution to the problem of achieving an even, pulse-free and safe supply of powder, alloying additives, refining agents, charge powder and/or reducing agents to a metallurgical melt. Also environmental problems in the form of dust and clogging, which were obtained earlier, have been solved. The invention according to the older application is characterised in that a lance and a charging container are interconnected to form one unit, which is raisable and lowerable relative to the melt (which is to be further charged, supplied with alloying additives, refined, decarburized and/or reduced). Despite long transportation paths to the melt, it is possible to obtain an even, efficient, and easily controllable injection, for example through the roof of a channel-type injection furnace.

A problem with this form of injection, however, is the achievement of a proper, desired grain size for the powder to be injected, as it is desirable to avoid supplying, for example, coarse powder, which for example, may cause clogging of supply conduits or cause undesirable results in the metallic melt. It is also desirable to achieve an even supply and not, for example, pulsating charging of the melt. In other words, it is desirable to achieve as disturbance-free an injection as possible, and the means according to the present invention provides a solution to the problems mentioned as well as other associated problems.

SUMMARY OF THE INVENTION

The apparatus according to the present invention is characterised in that at least one filling pipe for powder from a storage container (for example a bag or a large box) is connected to the charging container, the pipe being arranged to pass through at least one sieve for separation of undesired grain size, for example coarser grains, and for forwarding grains of a desired grain size. This results in a so-called safety sieving, which provides disturbance-free injection so that coarse grains cannot cause a stoppage in the transport of powder. Of course, it could also be desirable to separate too fine-grained powder grains, and this is also possible in the apparatus according to the present invention. It is also possible to remove impurities from the intended charging powder in this manner. The apparatus makes possible a powder processing which is extremely advantageous to the environment, involving a minimum formation of dust and very little work contribution.

BRIEF DESCRIPTION OF THE DRAWINGS

The invention is exemplified in greater detail in the accompanying drawings, wherein.

DETAILED DESCRIPTION

Figure 1:
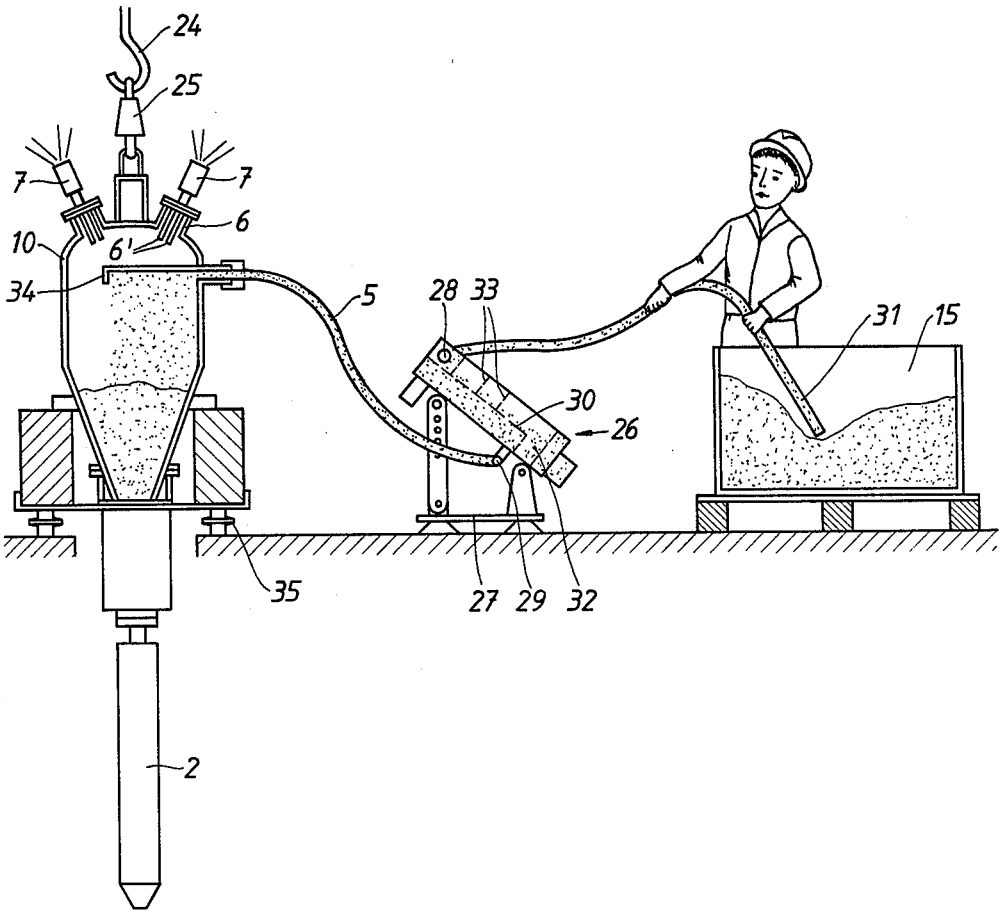
FIG. 1 shows a side view of an apparatus according to the invention.

The charging device itself consists of storage container 10 and lance 2 connected thereto, and this device is in all essentials described in the above-mentioned U.S. patent application. The lance is intended to be dipped into the melt, but in certain cases its orifice may be allowed to remain above the surface of the melt. Charging container 10 with attached lance 2 is shown suspended from hook 24, below which and above charging container 10, there is arranged a pair of scales, the output signals of which is a measure of the charging material (powder) present in the charging container and the lance. Ejectors 7 are arranged at the upper part of charging container 10, and adjacent to these there are arranged filters 6' for separation of dust, impurities, small grains, etc., from the charge container or from another part of the device, and this results in dust-free air at the exhaust nozzle of the ejector. At least one conveying pipe 5 for powder material is connected to storage container 15, which powder is intended to be transported therefrom via sieve means 26.

Sieve means 26 consists of an inclined box, which is connected to vibrating device 27 of a convential kind. The box is provided with inlet 28 at its upper portion and an outlet for charging powder 29 at its lower portion. The box is provided with sieving mesh 30, and the powder is sucked into the upper side of this mesh. Powder of a desired grain size passes mesh 30 and is sucked out at outlet 29 through pipe 5 to charging container 10 through ejection effect of ejector devices 7. The ejectors could, of course, also be arranged adjacent to conveying pipe 5 and the transportation of powder can be done otherwise than by means of ejectors. Powder is obtained from storage container 15 through suction nozzle 31 or any other suitable manner. It is readily apparent that this method does not require much work. Powder which does not pass mesh 30 is transported above the mesh to outlet 32 for coarse powder, where it is carried away in a suitable manner. It is possible to arrange several chambers inside the box for different powder sizes. It is also possible to arrange sieve 26 such that too fine-grained powder is separated, but this is not shown in the figure. At the right-hand part of the box there are shown chambers for different grain sizes of powder. Thus, the sieve consists of a vibrating plane sieve and it is enclosed in a tight box 26, the inclination of which can be varied. The sieving capacity is determined by the vibrating force, the inclination and the distance of wipers 33 from sieving mesh 30.

The powder from pipe 5 is introduced below screen 34 in charging container 10, and the supply of the powder is carried out in the same way as shown in principle in the above-mentioned U.S. patent application. Charging container 10 can also be weighed by means of weighing means 35 arranged below the charging container. This weighing is an alternative to the weighing performed by weighing device 25.

Figure 2:
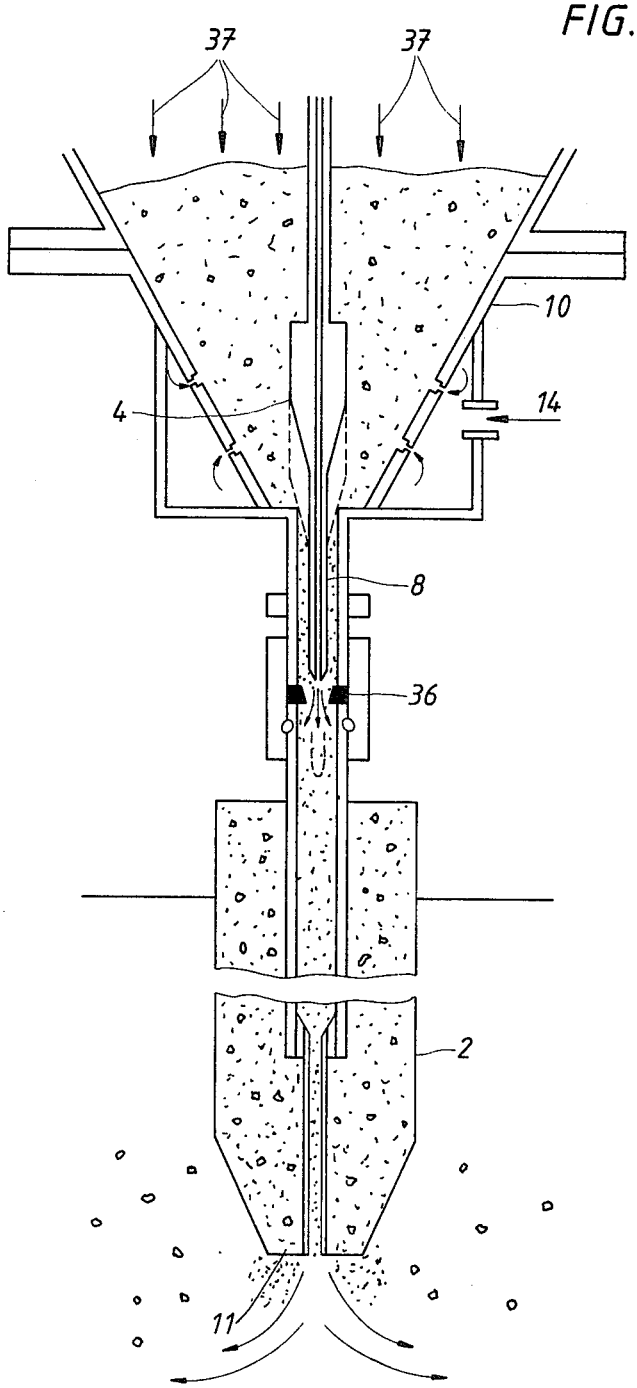
FIG. 2 shows a detail of the charging device.

FIG. 2 shows the lower part of charging container 10 with central tube 8 which is hollow and intended for pressure gas for ejector transport of the powder down towards the melt at lance 2. Powder is blown out at nozzle 11 according to FIG. 2. As described in the U.S. patent application, the powder can be kept fluidized at the lance opening by the supply of gas at inlet 14, thus preventing the powder from adhering to the lance. Below pressure gas tube 8 there is arranged throttle plate 36, which determines the quantity of powder that is transported. By blowing out gas centrally at the upper edge of throttle plate 36 through narrow tube 8, an ejector effect and additional driving force are obtained for the powder transport in excess of the gravity transportation. The supply of pressure gas, such as air or another gas, can be made separately through the hollow piston rod or can be connected directly to a pressure release valve (not shown) on the lid of the filter housing at ejector 7. Tube 8 terminates in bottom valve 4, which can be used for shutting off the powder transport (see the dashed-line position in FIG. 2). The pressure of the container is shown in principle by arrows 37.

During injection, charging container 10 is subjected to overpressure and the transportation starts when bottom valve 4 at lance 2 is opened by a compressed-air cylinder (not shown in the present application but disclosed in the U.S. patent application). The powder is passed through throttle plate 36 to lance tip 11 and further out into the melt. The powder flow is determined by the diameter of throttle plate 36 and to a certain extent by the overpressure, which is adjusted by a pressure regulator on the sender at the charging container. After passing the pressure regulator, the conduit is divided so that part of the carrier gas passes through fluidizing chamber 14 such that a desired pressure on the powder is obtained from above. By throttle valves or nonreturn valves these two gas flows can be adjusted in an appropriate manner. The fluidization at 14 breaks up the powder and simultaneously prevents it from clogging (i.e. prevents the formation of agglomerated portions). For the powder to be fluidized initially, the above-mentioned pressure release valve is opened at one of the filter housings 6 (FIG. 1).

When the bottom valve is closed, a lance ejector can be used, for example, for cooling the lance after injection. The lance is fixed to the powder sender 10 by means of a ball and socket gear shifting. In connection with the lance being mounted on the sender, also a suitable throttle plate 36 is inserted. Sealing can be achieved by means of O-rings.

The described principle of handling and transporting powder provides a completely safe injection and a very low consumption of carrier gas. This also involves minimum splashing, which is of importance in those cases where injection takes place in an open furnace or ladle.

The apparatus according to the above can be varied in many ways within the scope of the following claims.

What is claimed is:

1. Apparatus for injection of powder into a metal melt, comprising a charging container; an injection device for injecting powder into said charging container; a storage container for powder; at least one filling pipe for transporting powder from said storage container to said charging container, at least one sieve for separation of grains of an undesirable grain size and for transporting grains of a desired grain size from said storage container; a lance; an ejector device for providing said lance with pressurized gas; and a throttle valve for feeding powder from said charging container through said lance to said metal melt.

2. Apparatus according to claim 1, wherein said at least one sieve included an inclined vessel having a sieving mesh, and an inlet for unfiltered material at the top of said vessel, above said mesh, and an outlet for material which has passed through the mesh at the bottom of said vessel and connected to said filling pipe, and at least one other outlet for coarser material which has not been able to pass through said mesh.

3. Apparatus according to claims 1 or 2, further comprising a vibration device for vibrating said vessel and said sieving mesh.

4. Apparatus according to claim 1, further comprising suction means for filling of said charging container with powder from said storage container through said sieve and filling pipe.

5. Apparatus according to claim 2 further comprising suction means for filling of said charging container with powder from said storage container through said sieve and filling pipe.

6. Apparatus according to claims 4 or 5, further comprising filters arranged at said suction means for separation of non-powder particles from said powder.

7. Apparatus for injection of powder into a metal melt, comprising, a charging container; an injection device for injecting powder into said charging container for subsequent injection into said metal melt; a storage container for powder; at least one filling pipe for transporting powder from said storage container to said charging container; at least one sieve for separation of grains of an undesirable grain size, suction pump means transporting powder through said sieve and forwarding grains of a desired grain size from said storage container to said charging container through said at least one filling pipe, said charging container being connected to a lance device for feeding powder to the melt.

* * * * *